US011287158B2

(12) United States Patent
Kondo et al.

(10) Patent No.: US 11,287,158 B2
(45) Date of Patent: Mar. 29, 2022

(54) HEAT EXCHANGER AND HOT WATER APPARATUS

(71) Applicant: NORITZ CORPORATION, Hyogo (JP)

(72) Inventors: Masaki Kondo, Hyogo (JP); Takeshi Ohigashi, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 219 days.

(21) Appl. No.: 16/177,454

(22) Filed: Nov. 1, 2018

(65) Prior Publication Data

US 2019/0154300 A1 May 23, 2019

(30) Foreign Application Priority Data

Nov. 21, 2017 (JP) ..... JP2017-223712

(51) Int. Cl.
*F24H 1/14* (2006.01)
*F28D 7/00* (2006.01)
(Continued)

(52) U.S. Cl.
CPC ..... *F24H 1/145* (2013.01); *F23L 1/00* (2013.01); *F24H 1/30* (2013.01); *F24H 1/40* (2013.01);
(Continued)

(58) Field of Classification Search
CPC ... F24H 1/145; F24H 1/41; F24H 1/44; F24H 1/30; F24H 1/40; F24H 9/0026;
(Continued)

(56) References Cited

U.S. PATENT DOCUMENTS 3,963,071 A * 6/1976 Levin ..... F23D 11/44 165/142
3,973,621 A * 8/1976 Bow ..... F28D 7/1653 165/83
(Continued)

FOREIGN PATENT DOCUMENTS

CN 102109281 6/2011
CN 103175419 6/2013
(Continued)

OTHER PUBLICATIONS

"Office Action of China Counterpart Application," dated Apr. 23, 2021, with English translation thereof, p1-p14.

*Primary Examiner* — Steven B McAllister
*Assistant Examiner* — Charles R Brawner
(74) *Attorney, Agent, or Firm* — JCIPRNET

(57) ABSTRACT

Provided are a heat exchanger capable of cooling a shell plate and having good assemblability and a hot water apparatus having the same. A primary heat exchanger includes a heat exchanging portion, a shell plate, and a shell pipe portion. The shell plate surrounds the heat exchanging portion. The shell pipe portion is for cooling the shell plate. The shell plate includes a front surface portion and a main body portion. The main body portion is installed on the front surface portion and is formed by bending one sheet of plate into a U shape. The shell pipe portion is bent in a U shape along an inner surface of the main body portion and installed on the inner surface.

10 Claims, 9 Drawing Sheets

(51) Int. Cl.

| | |
|---|---|
| ***F28F 9/02*** | (2006.01) |
| ***F23L 1/00*** | (2006.01) |
| ***F28D 7/06*** | (2006.01) |
| ***F28D 7/16*** | (2006.01) |
| ***F24H 1/41*** | (2006.01) |
| ***F24H 9/00*** | (2006.01) |
| ***F28D 7/08*** | (2006.01) |
| ***F24H 1/44*** | (2006.01) |
| ***F24H 1/30*** | (2006.01) |
| ***F24H 1/40*** | (2006.01) |
| ***F28F 1/12*** | (2006.01) |

(52) U.S. Cl.
CPC ..... *F24H 1/41* (2013.01); *F24H 1/44* (2013.01); *F24H 9/0015* (2013.01); *F24H 9/0026* (2013.01); *F28D 7/005* (2013.01); *F28D 7/06* (2013.01); *F28D 7/087* (2013.01); *F28D 7/16* (2013.01); *F28F 1/126* (2013.01); *F28F 9/026* (2013.01)

(58) Field of Classification Search
CPC ..... F24H 9/0015; F28D 7/087; F28D 7/06; F28D 7/16; F28D 7/05; F28F 9/026; F28F 1/126; F23L 1/00
USPC ..... 122/235.14, 235.22
See application file for complete search history.

(56) References Cited

U.S. PATENT DOCUMENTS

| | | | | |
|---|---|---|---|---|
| 10,481,012 | B2 * | 11/2019 | Nagasaka | F24H 9/0026 |
| 2002/0050342 | A1 * | 5/2002 | Gerstmann | F28D 7/026 165/109.1 |
| 2007/0266714 | A1 * | 11/2007 | Fiedler | F25B 9/14 62/6 |
| 2010/0132632 | A1 * | 6/2010 | Kaupp | F24H 9/0094 122/235.23 |
| 2017/0321970 | A1 * | 11/2017 | Choi | F28F 9/0131 |
| 2017/0350618 | A1 * | 12/2017 | Ojiro | F24H 1/44 |
| 2018/0031273 | A1 * | 2/2018 | Cai | F28F 3/12 |
| 2019/0024941 | A1 * | 1/2019 | Ono | F23D 14/14 |

FOREIGN PATENT DOCUMENTS

| | | |
|---|---|---|
| CN | 106288868 | 1/2017 |
| CN | 107339898 | 11/2017 |
| JP | S57109440 | 7/1982 |
| JP | S5866792 | 4/1983 |
| JP | S62272062 | 11/1987 |
| JP | 2004347230 | 12/2004 |
| JP | 2017116203 | 6/2017 |

* cited by examiner

HEAT EXCHANGER AND HOT WATER APPARATUS

CROSS-REFERENCE TO RELATED APPLICATION

This application claims the priority benefit of Japan application serial no. 2017-223712, filed on Nov. 21, 2017. The entirety of the above-mentioned patent application is hereby incorporated by reference herein and made a part of this specification.

BACKGROUND

Technical Field

The disclosure relates to a heat exchanger and a hot water apparatus, more particularly, to a heat exchanger and a hot water apparatus having a shell pipe portion for cooling a shell plate.

Description of Related Art

In a conventional heat exchanger, since a temperature of a shell plate rises due to combustion gas supplied from a burner, it is necessary to cool the shell plate. For this reason, a heat exchanger having a shell pipe portion for cooling the shell plate has been proposed.

A heat exchanger having a shell pipe portion is described, for example, in Japanese Laid-open No. 2017-116203 (Patent Document 1). In the heat exchanger described in this publication, a combustion casing is configured by four side plates surrounding fins and a heat absorbing pipe. Further, a separate shell pipe portion is provided on each of the four side plates of the combustion casing.

Since the heat exchanger described in the above-described publication has four side plates and a shell pipe portion separately provided on each of the four side plates, the number of components is high. For this reason, assembling of the heat exchanger is complicated.

SUMMARY

A heat exchanger of an embodiment of the disclosure includes a heat exchanging portion, a shell plate, and a shell pipe portion. The shell plate surrounds the heat exchanging portion. The shell pipe portion is for cooling the shell plate. The shell plate includes a front surface portion and a main body portion. The main body portion is installed on the front surface portion and is formed by bending one sheet of plate into a U shape. The shell pipe portion is bent into a U shape along an inner surface of the main body portion and is installed on the inner surface.

DESCRIPTION OF THE EMBODIMENTS

Figure 1:
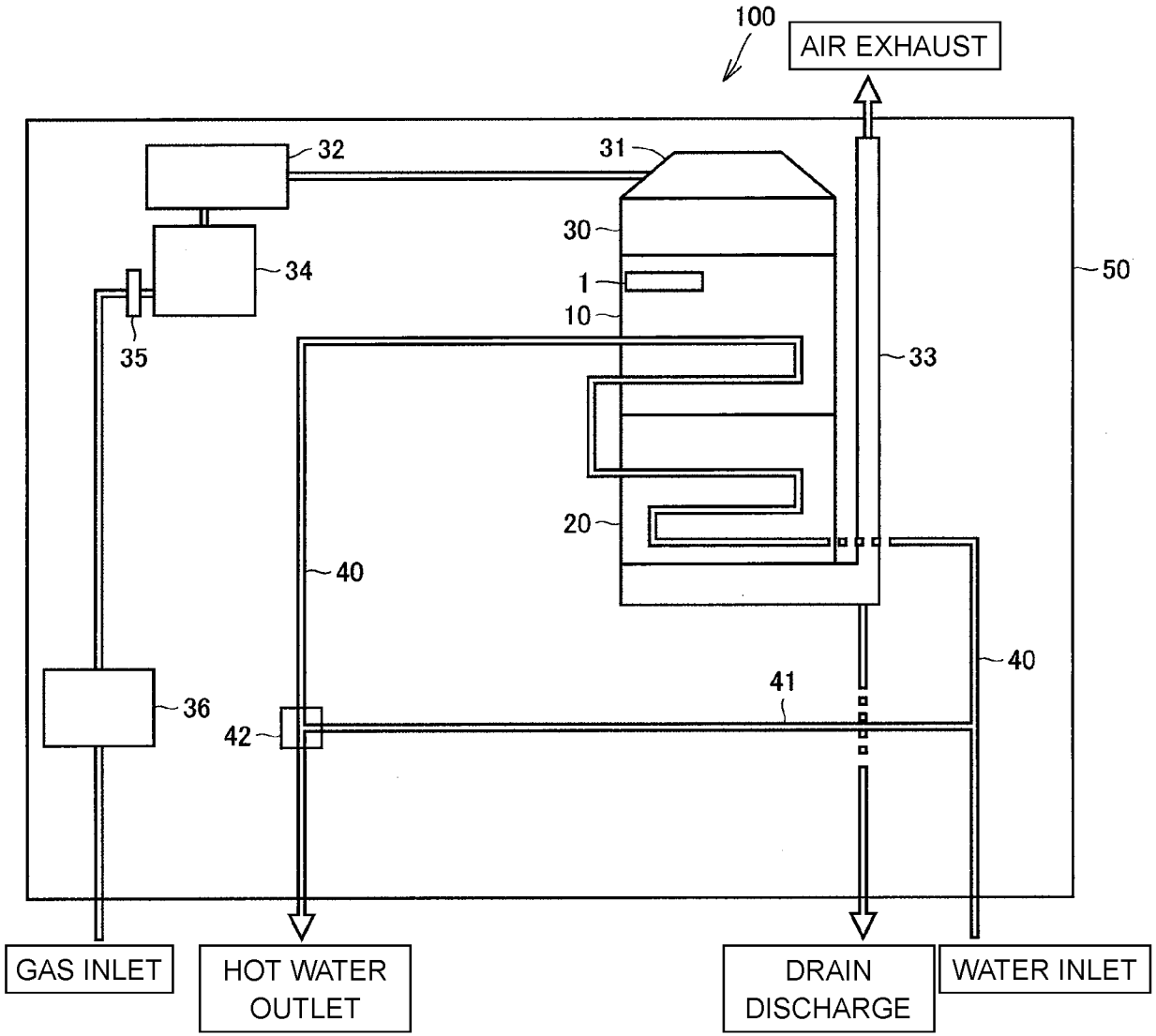
FIG. 1 a diagram schematically showing a configuration of a hot water apparatus according to an embodiment of the disclosure.

The embodiments of the disclosure provide a heat exchanger capable of cooling a shell plate and having good assemblability, and a hot water apparatus having the same.

A heat exchanger of an embodiment of the disclosure includes a heat exchanging portion, a shell plate, and a shell pipe portion. The shell plate surrounds the heat exchanging portion. The shell pipe portion is for cooling the shell plate. The shell plate includes a front surface portion and a main body portion. The main body portion is installed on the front surface portion and is formed by bending one sheet of plate into a U shape. The shell pipe portion is bent into a U shape along an inner surface of the main body portion and is installed on the inner surface.

According to the heat exchanger of one or some exemplary embodiments of the disclosure, the shell plate can be cooled by the shell pipe portion. Also, since the main body portion of the shell plate is formed by bending one sheet of plate into a U shape, the number of components of the shell plate can be reduced. Further, since the shell pipe portion is bent into a U shape, the number of components of the shell pipe portion can be reduced. Therefore, assemblability of the heat exchanger can be improved. Furthermore, since the shell pipe portion is bent in a U shape along the inner surface of the main body portion, it is easy to install the shell pipe portion on the inner surface of the main body portion. Therefore, the assemblability of the heat exchanger can be improved.

In the above-described heat exchanger, the inner surface of the main body portion includes a recessed portion. The recessed portion is formed to be fitted to the shell pipe portion. Therefore, the shell pipe portion can be held by the recessed portion. Also, the shell pipe portion can be installed along the recessed portion.

In the above-described heat exchanger, the main body portion includes a back surface portion, a first side surface portion and a second side surface portion, and the back surface portion together with the front surface portion is disposed to sandwich the heat exchanging portion. The first side surface portion and the second side surface portion are disposed to extend from both ends of the back surface portion toward the front surface portion. The shell pipe portion includes a back pipe portion installed on the back surface portion, a first side pipe portion installed on the first side surface portion, a first curved portion which connects the back pipe portion to the first side pipe portion, a second side pipe portion installed on the second side surface portion, and a second curved portion which connects the back pipe portion with the second side pipe portion. The first curved portion is disposed with a first gap between the first curved portion and a first corner portion formed by the back surface portion and the first side surface portion, and the second curved portion is disposed with a second gap between the second curved portion and a second corner portion formed by the back surface portion and the second side surface portion. Therefore, drainage can flow through the first gap and the second gap. Thus, it is possible to prevent drainage accumulation from being formed on the shell pipe portion. Therefore, concentration of the drainage due to evaporation of the drainage in this drainage accumulation can be minimized. As a result, corrosion of the shell pipe portion due to condensed drainage can be minimized.

In the above-described heat exchanger, a center of the shell pipe portion is located further inside the main body portion than the inner surface of the main body portion. Therefore, since a flow of combustion gas to the shell plate is hindered by the shell pipe portion, it is possible to minimize the amount of combustion gas reaching the shell plate. As a result, it is possible to minimize an increase in a temperature of the shell plate.

In the above-described heat exchanger, the shell pipe portion comprises a first cooling pipe bent in a U shape and a second cooling pipe bent in a U shape which are disposed side by side in a vertical direction. The first cooling pipe is connected in series to the second cooling pipe. Each of the first cooling pipe and said second cooling pipe is installed to extend in a horizontal direction. Since the first cooling pipe and the second cooling pipe are disposed side by side in the vertical direction, a range in which the shell plate is cooled can be expanded in the vertical direction. Also, in a case in which the first cooling pipe is connected in parallel to the second cooling pipe, when one of the first cooling pipe and the second cooling pipe is clogged with scale precipitated due to minerals contained in tap water, hot water flows to the other side which is not clogged with the scale. Therefore, the temperature of the shell plate around the one clogged with scale becomes extremely high. In the above-described heat exchanger, since the first cooling pipe is connected in series to the second cooling pipe, when one of the first cooling pipe and the second cooling pipe is clogged with the scale, no hot water flow through the entire shell pipe portion. Therefore, it is easy to find out that one of the first cooling pipe and the second cooling pipe is clogged with the scale. Thus, when one of the first cooling pipe and the second cooling pipe is clogged with the scale, it is possible to prevent the temperature of the shell plate from becoming extremely high by stopping the hot water apparatus. Further, since the first cooling pipe and the second cooling pipe are installed side by side in the horizontal direction, the first cooling pipe and the second cooling pipe can be formed in the same shape. Therefore, it is possible to reduce the number of types of component. Thus, production efficiency can be improved.

The above-described heat exchanger may further include a first header member installed on the front surface portion. The first cooling pipe and the second cooling pipe form a series of water flow paths via the first header member. Since the first header member protrudes from the shell plate less than a bend pipe, it is possible to make the heat exchanger compact.

In the above-described heat exchanger, the first cooling pipe is disposed above the second cooling pipe. One end of the first cooling pipe is connected to a water inlet portion. The other end of the first cooling pipe is connected to the second cooling pipe via the first header member. Therefore, the hot water can flow downward from the first cooling pipe to the second cooling pipe via the first header member.

In the above-described heat exchanger, the first header member comprises a first end connected to the first cooling pipe and a second end connected to the second cooling pipe. The first header member is inclined downward from the first end toward the second end. Vapor is accumulated in an upper end inside the first header member. When the first header member is formed horizontally from the first end toward the second end, since a volume in which the vapor accumulates in this upper end increases, an area to which chlorine components contained in the vapor adhere in this upper end increases. In the above-described primary heat exchanger, since the first header member is inclined downward from the first end toward the second end, the volume in which the vapor accumulates in the upper end inside the pipe of the first header member decreases. Therefore, it is possible to reduce the area to which chlorine components contained in the vapor adhere in this upper end. Thus, corrosion of the first header member due to the chlorine components can be minimized.

In the above-described heat exchanger, the first header member is curved from the first end toward the second end. Therefore, a distance along the front surface portion of the first header member can be made longer than in a case in which the first header member is formed linearly from the first end toward the second end. Thus, a cooling effect due to the first header member in the front surface portion can be increased.

The above-described heat exchanger may further include a second header member installed on the front surface portion. The shell pipe portion includes a third cooling pipe disposed to be parallel to the first cooling pipe and the second cooling pipe in the vertical direction. The third cooling pipe is disposed below the second cooling pipe. The second cooling pipe and the third cooling pipe form a series of water flow paths via the second header member. The second header member is formed to have the same shape as the first header member. Therefore, it is possible to reduce the number of types of component. Thus, production efficiency can be improved.

In the above-described heat exchanger, the heat exchanging portion comprises a plurality of fins stacked on each other, and a plurality of fin pipes which pass through the plurality of fins. A linear expansion coefficient of a material of each of the plurality of fins and the shell plate is smaller than a linear expansion coefficient of a material of the plurality of fin pipes. The temperature of each of the plurality of fins and the shell plate around which the combustion gas flows is higher than the temperature of the plurality of fin pipes through which the hot water flows. Since the linear expansion coefficient of the material of each of the plurality of fins and the shell plate is smaller than the linear expansion coefficient of the material of the plurality of fin pipes, it is possible to alleviate stress concentration due to thermal stress generated between the plurality of fin pipes and the plurality of fins and the shell plate.

A hot water apparatus of an embodiment of the disclosure includes the above-described heat exchanger and a burner which generates a heating gas to be supplied to the heat exchanger. According to the hot water apparatus of one or some embodiments of the disclosure, it is possible to provide the hot water apparatus having the primary heat exchanger which can cool the shell plate and which has good assemblability.

As described above, according to the embodiments of the disclosure, it is possible to provide a heat exchanger capable of cooling a shell plate and having good assemblability, and a hot water apparatus having the same.

Hereinafter, embodiments of the disclosure will be described below with reference to the drawings.

First, referring to FIG. 1, a configuration of a hot water apparatus 100 according to an embodiment of the disclosure will be described.

As shown in FIG. 1, the hot water apparatus 100 according to the embodiment mainly includes a spark plug 1, a primary heat exchanger (sensible heat recovery heat exchanger) 10, a secondary heat exchanger (latent heat recovery heat exchanger) 20, a burner 30, a chamber 31, an blowing device 32, a duct 33, a venturi 34, an orifice 35, a gas valve 36, a pipe 40, a bypass pipe 41, a three-way valve 42, and a housing 50. All of the above components except for the housing 50 are disposed inside the housing 50. The above-mentioned components are the same as those in the related art except for the primary heat exchanger 10.

A fuel gas flows to the venturi 34 through the gas valve 36 and the orifice 35. A mixed gas mixed by the venturi 34 is delivered to the blowing device 32. The blowing device 32 is for supplying the mixed gas to the burner 30. The blowing device 32 is connected to the chamber 31, and the chamber 31 is connected to the burner 30. The mixed gas supplied from the blowing device 32 is delivered to the burner 30 through the chamber 31. The burner 30 is for generating a heating gas (combustion gas) which is supplied to the primary heat exchanger 10. The mixed gas blown out from the burner 30 is ignited by the spark plug 1 and becomes a combustion gas.

The burner 30, the primary heat exchanger 10, and the secondary heat exchanger 20 are connected so that the combustion gas sequentially passes through the primary heat exchanger 10 and the secondary heat exchanger 20 to exchange heat with hot water. The duct 33 is connected to the secondary heat exchanger 20, and the duct 33 extends to the outside of the housing 50. Accordingly, the combustion gas which has passed through the secondary heat exchanger 20 is discharged outside of the housing 50 through the duct 33. A portion of the pipe 40 on a hot water outlet side from the primary heat exchanger 10 and the bypass pipe 41 are connected by the three-way valve 42.

Next, a configuration of the primary heat exchanger (heat exchanger) 10 used in the hot water apparatus 100 will be described with reference to FIGS. 2 to 11.

Figure 2:
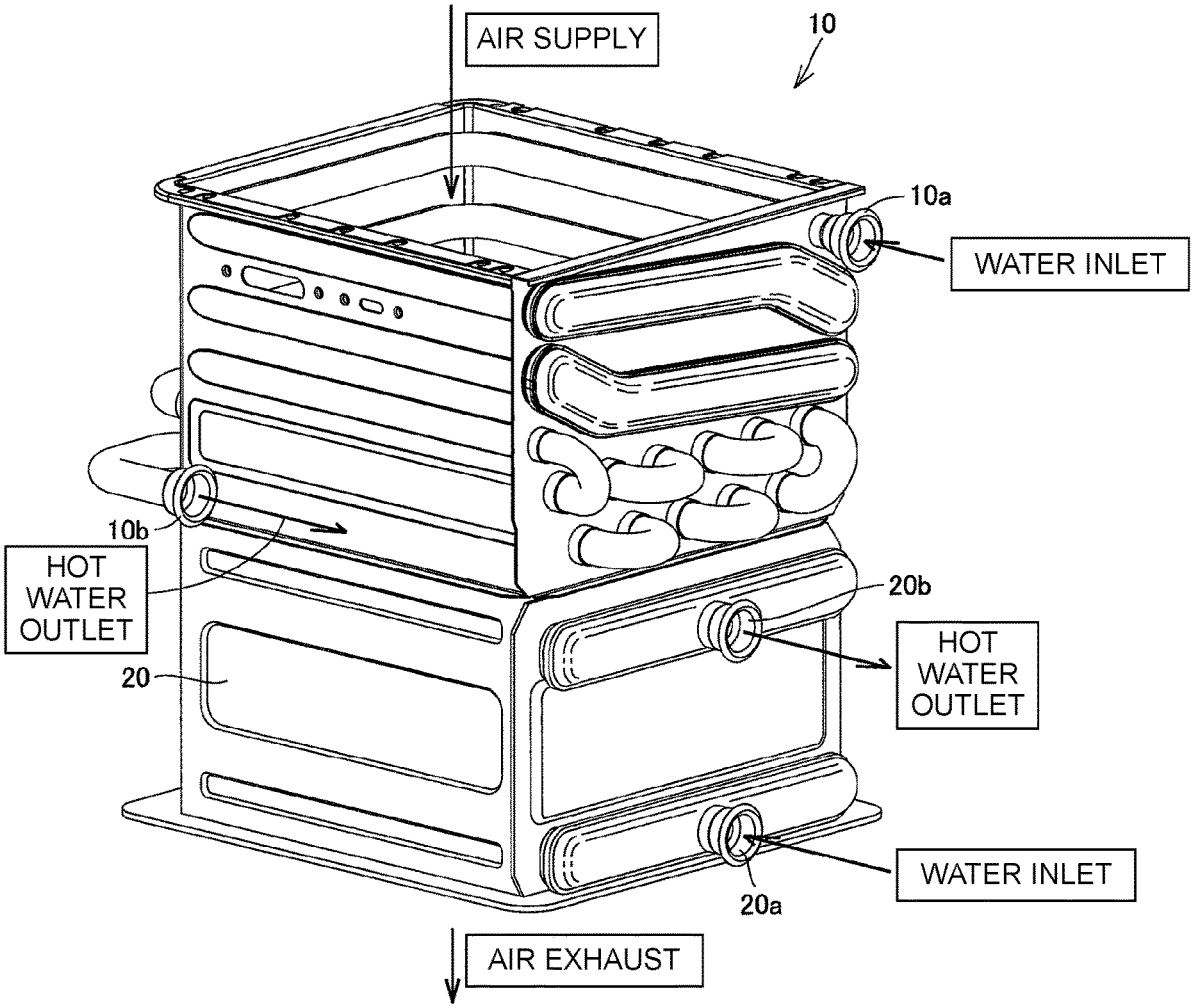
FIG. 2 is a perspective view schematically showing a configuration of a primary heat exchanger and a secondary heat exchanger according to the embodiment of the disclosure.

As shown in FIG. 2, the primary heat exchanger 10 of the embodiment is connected to the secondary heat exchanger 20. The combustion gas is supplied through an upper opening of the primary heat exchanger 10, and the combustion gas is exhausted through a lower opening of the secondary heat exchanger 20. The hot water entering the secondary heat exchanger 20 from a water inlet portion 20*a* of the secondary heat exchanger 20 exchanges heat with the combustion gas, then exits from a hot water outlet portion 20*b* and enters a water inlet portion 10*a* of the primary heat exchanger 10 via a pipe (not shown). The hot water which has entered the water inlet portion 10*a* of the primary heat exchanger 10 exchanges heat with the combustion gas and then exits from a hot water outlet portion 10*b*. The water inlet portion 10*a* is a portion through which the hot water first enters the primary heat exchanger 10. The hot water outlet portion 10*b* is a portion through which the hot water finally exits from the primary heat exchanger 10.

Figure 3:
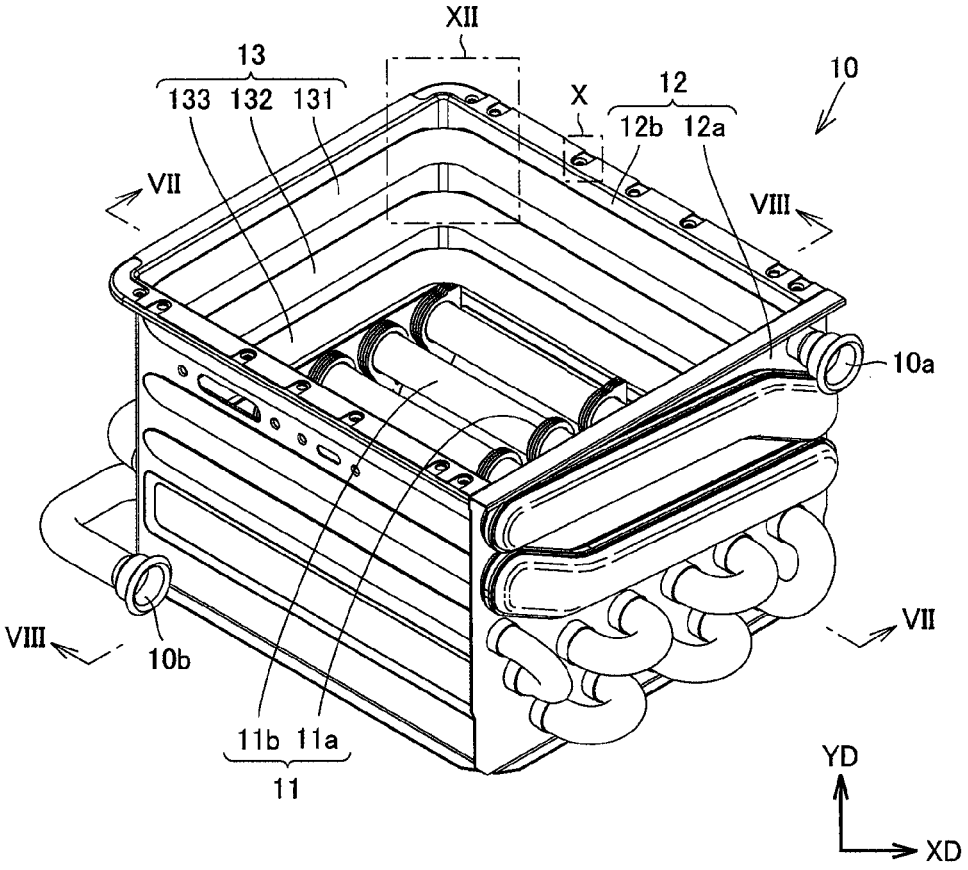
FIG. 3 a perspective view schematically showing a configuration of a heat exchanger according to the embodiment of the disclosure from a front surface side.
Figure 4:
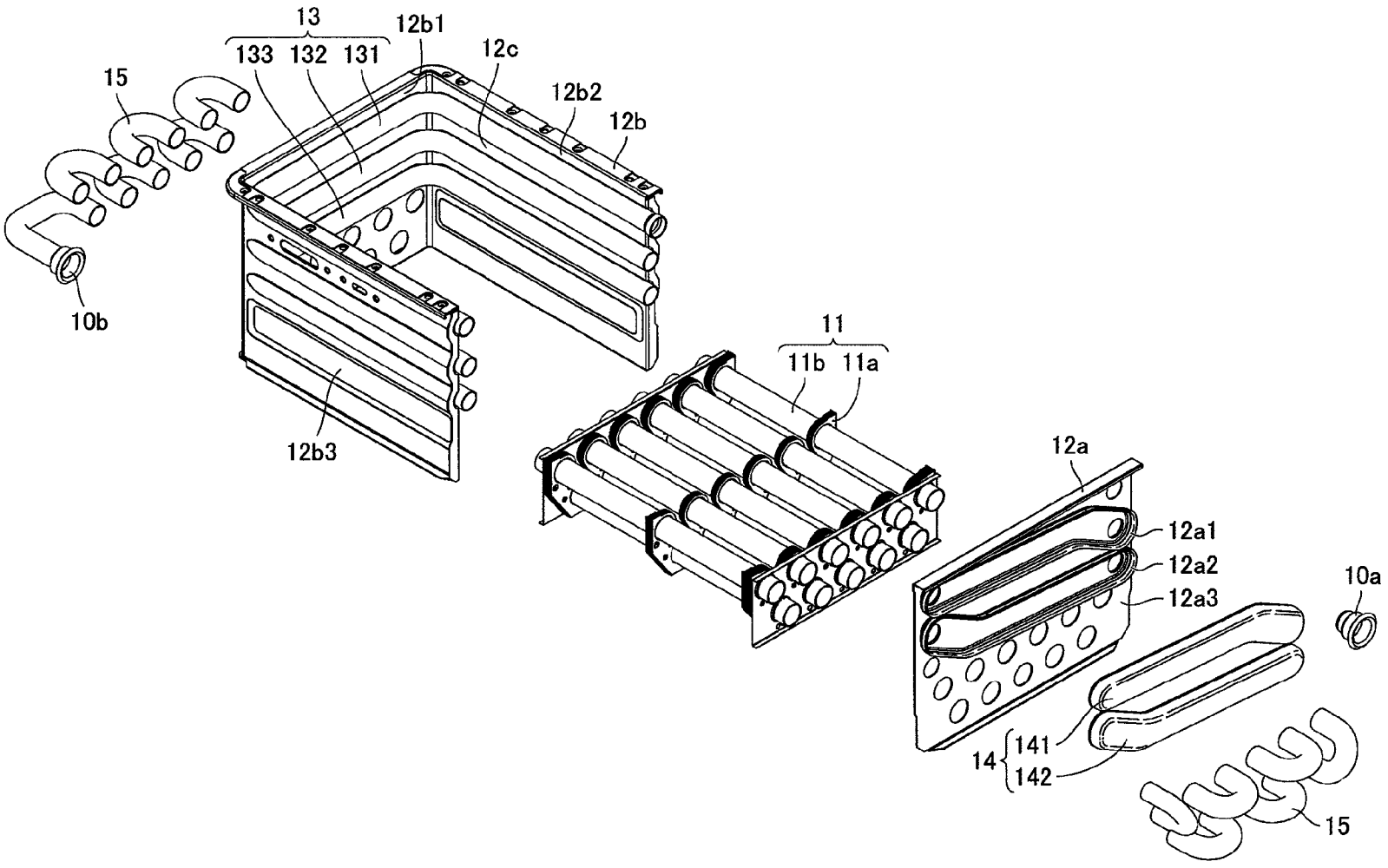
FIG. 4 is an exploded perspective view schematically showing the configuration of the heat exchanger according to the embodiment of the disclosure.

As shown in FIGS. 3 and 4, the primary heat exchanger 10 includes the water inlet portion 10*a*, the hot water outlet portion 10*b*, a heat exchanging portion 11, a shell plate 12, a shell pipe portion 13, a header member 14, and a bend pipe 15.

The heat exchanging portion 11 is for exchanging heat between the combustion gas flowing in an outer side and the hot water flowing in an inner side. The heat exchanging portion 11 includes a plurality of fins 11*a* and a plurality of fin pipes 11*b*. The heat exchanging portion 11 is configured so that the combustion gas flows outside the plurality of fins 11*a* and the plurality of fin pipes 11*b* and the hot water flows inside the plurality of fin pipes lib. In FIGS. 3 to 7, for convenience of description, only some of the plurality of fins 11*a* are illustrated.

The plurality of fins 11*a* are stacked on each other. The plurality of fin pipes 11*b* pass through the plurality of fins 11*a*. The plurality of fins 11*a* are connected to outer circumferential surfaces of the plurality of fin pipes 11*b*. A linear expansion coefficient of a material of each of the plurality of fins 11*a* and the shell plate 12 is smaller than a linear expansion coefficient of a material of the plurality of fin pipes 11*b*. Specifically, for example, the material of each of the plurality of fins 11*a* and the shell plate 12 may be ferritic SUS (stainless steel), and the material of the plurality of fin pipes 11*b* may be austenitic SUS (stainless steel).

The shell plate 12 surrounds the heat exchange portion 11. The shell plate 12 includes a front surface portion 12*a* and a main body portion 12*b*. The main body portion 12*b* is installed on the front surface portion 12*a*. The main body portion 12*b* is formed by bending one sheet of plate into a U shape. Both ends of the main body portion 12*b* bent into a U shape are connected by the front surface portion 12*a*. The front surface portion 12*a* and the main body portion 12*b* form a square frame. The shell plate 12 has openings at the top and bottom. The shell plate 12 can supply the combustion gas to the inside of the shell plate 12 through the upper opening. The shell plate 12 can exhaust the combustion gas to the outside of the shell plate 12 through the lower opening.

The front surface portion 12*a* has pipe installation plates 12*a*1 and 12*a*2. The pipe installation plates 12*a*1 and 12*a*2 are installed on an outer surface 12*a*3 of the front surface portion 12*a*. As will be described later, the header member 14 is installed on the front surface portion 12*a*. A material of the front surface portion 12*a*, the pipe installation plates 12*a*1 and 12*a*2, and the header member 14 may be, for example, ferritic SUS (stainless steel). When these members are brazed, these members have a large brazed area. Therefore, residual stress generated during brazing in a furnace can be minimized by standardizing these members with ferritic SUS (stainless steel).

The main body portion 12*b* is disposed on three sides among four sides around the heat exchanging portion 11 and is not disposed on the remaining one side. That is, the main body portion 12*b* is configured to open one surface of the four surfaces around the heat exchanging portion 11. Specifically, the main body portion 12*b* includes a back surface portion 12*b*1, a first side surface portion 12*b*2, and a second side surface portion 12*b*3. The back surface portion 12*b*1 is disposed to face the front surface portion 12*a*. The back surface portion 12*b*1 together with the front surface portion 12*a* is disposed to sandwich the heat exchanging portion 11.

The first side surface portion 12b2 and the second side surface portion 12b3 are disposed to extend from both ends of the back surface portion 12b1 toward the front surface portion 12a. The first side surface portion 12b2 and the second side surface portion 12b3 are disposed to face each other.

Figure 5:
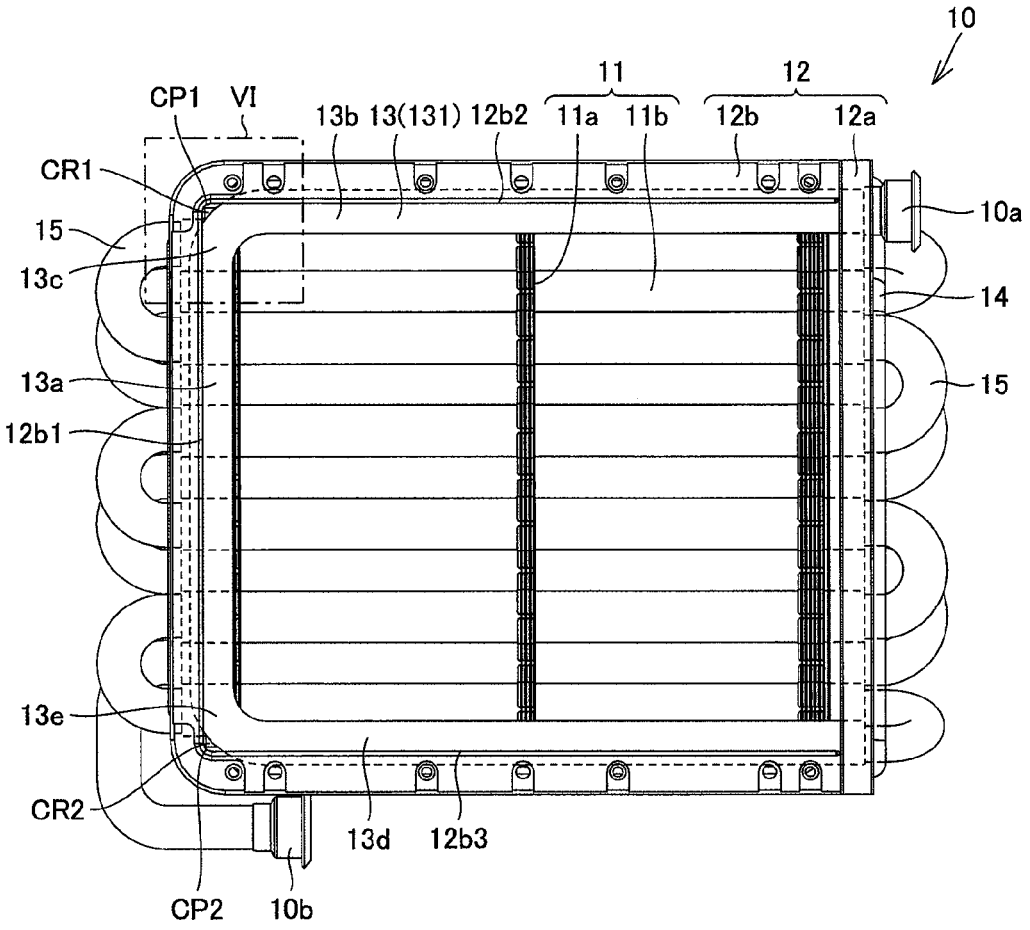
FIG. 5 is a top view schematically showing the configuration of the heat exchanger according to the embodiment of the disclosure.

As shown in FIGS. 4 and 5, the shell pipe portion 13 is bent into a U shape along an inner surface 12c of the main body portion 12b. The shell pipe portion 13 is installed on the inner surface 12c of the main body portion 12b.

The shell pipe portion 13 includes a back pipe portion 13a, a first side pipe portion 13b, a first curved portion 13c, a second side pipe portion 13d, and a second curved portion 13e. The back pipe portion 13a is installed on the back surface portion 12b1. The first side pipe portion 13b is installed on the first side surface portion 12b2. The first curved portion 13c connects the back pipe portion 13a with the first side pipe portion 13b. The second side pipe portion 13d is installed on the second side surface portion 12b3. The second curved portion 13e connects the back pipe portion 13a with the second side pipe portion 13d.

Figure 6:
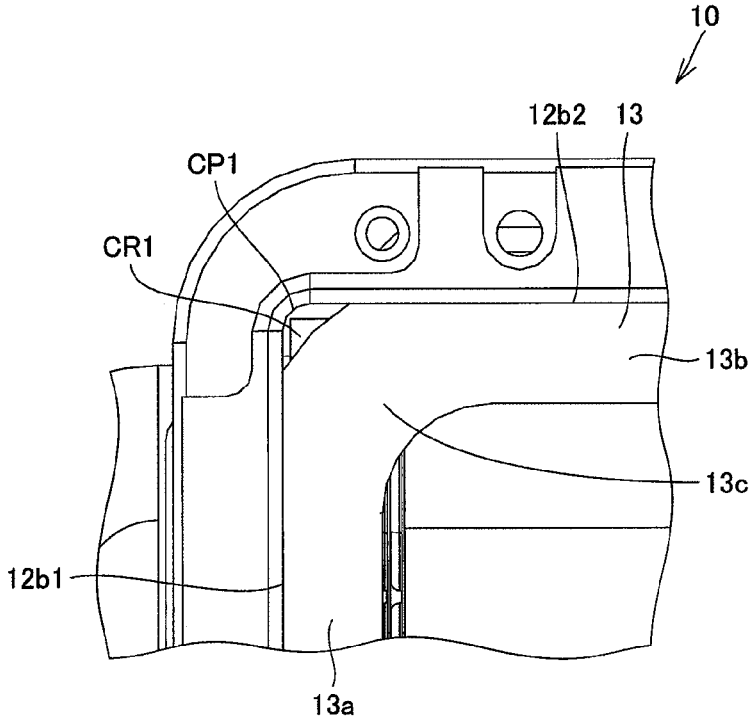
FIG. 6 is an enlarged view showing a portion VI of FIG. 5.

As shown in FIGS. 5 and 6, the first curved portion 13c is disposed with a first gap CR1 between the first curved portion 13c and a first corner portion CP1 formed by the back surface portion 12b1 and the first side surface portion 12b2. The second curved portion 13e is disposed with a second gap CR2 between the second curved portion 13e and a second corner portion CP2 formed by the back surface portion 12b1 and the second side surface portion 12b3.

Figure 7:
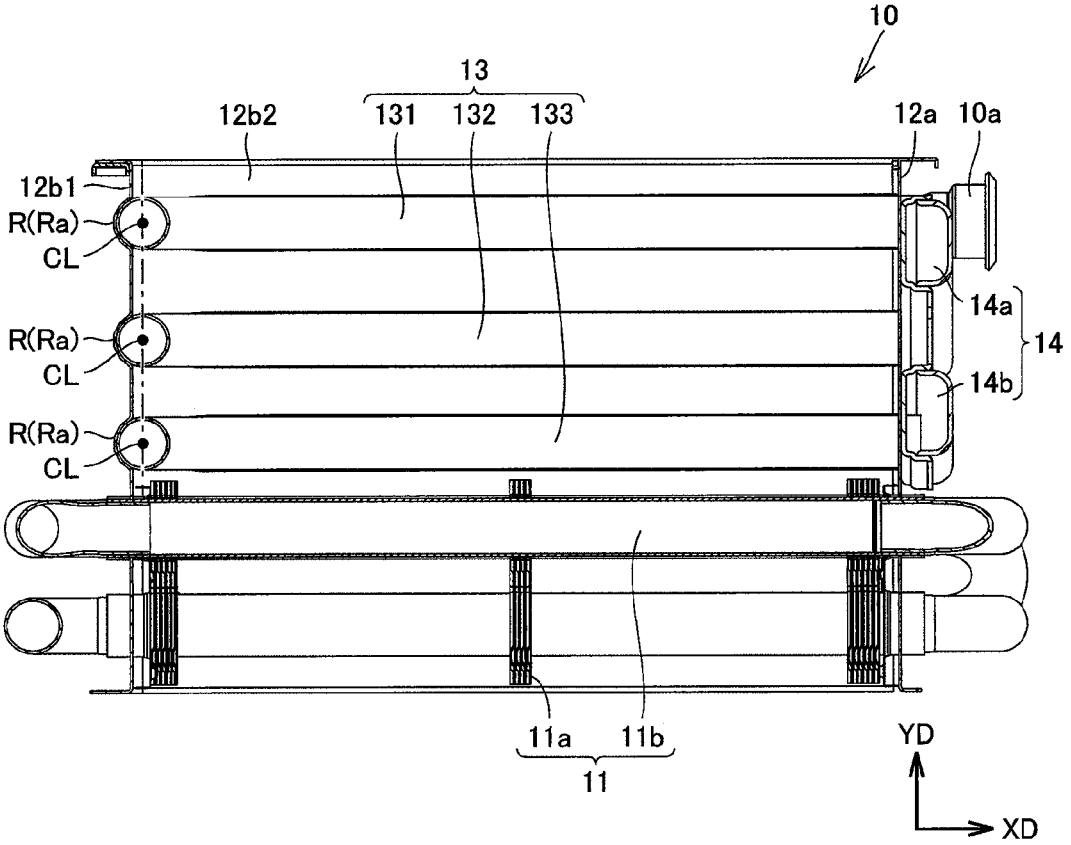
FIG. 7 is a cross-sectional view taken along line VII-VII of FIG. 3.

As shown in FIGS. 3 and 4, the shell pipe portion 13 includes a first cooling pipe 131, a second cooling pipe 132, and a third cooling pipe 133. As shown in FIGS. 4 and 7, each of the first cooling pipe 131, the second cooling pipe 132 and the third cooling pipe 133 is bent into a U shape. The first cooling pipe 131 and the second cooling pipe 132 are installed side by side in a vertical direction YD. The first cooling pipe 131 is connected in series to the second cooling pipe 132. The third cooling pipe 133 is installed to be parallel to the first cooling pipe 131 and the second cooling pipe 132 in the vertical direction YD. The second cooling pipe 132 is connected in series to the third cooling pipe 133.

The first cooling pipe 131 is disposed above the second cooling pipe 132. The second cooling pipe 132 is disposed above the third cooling pipe 133. That is, the third cooling pipe 133 is disposed below the second cooling pipe 132. Each of the first cooling pipe 131, the second cooling pipe 132, and the third cooling pipe 133 is installed to extend in a horizontal direction XD. Each of the first cooling pipe 131, the second cooling pipe 132, and the third cooling pipe 133 has the same shape.

Figure 8:
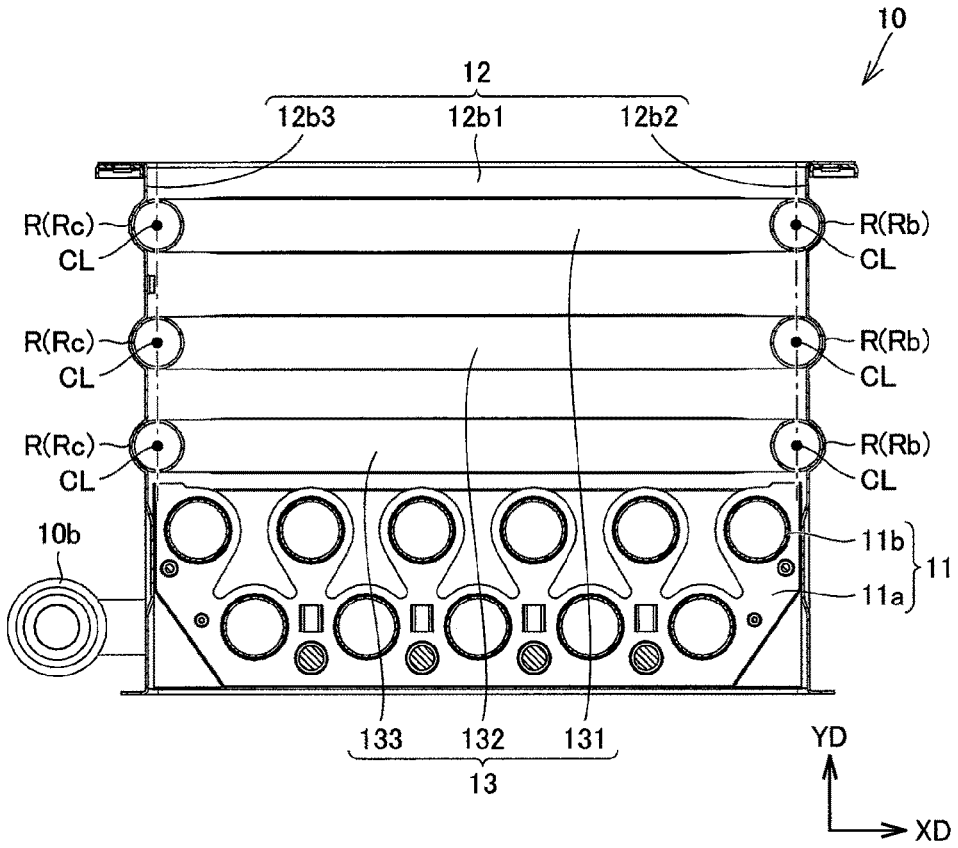
FIG. 8 is a cross-sectional view taken along line VIII-VIII of FIG. 3.

As shown in FIGS. 7 and 8, the inner surface 12c of the main body portion 12b includes a recessed portion R. The recessed portion R is configured to be fitted to the shell pipe portion 13. The recessed portion R includes a back recessed portion Ra, a first side recessed portion Rb and a second side recessed portion Rc. The back recessed portion Ra is provided in the inner surface 12c of the back surface portion 12b1. The back recessed portion Ra is configured to be fitted to each of the first cooling pipe 131, the second cooling pipe 132, and the third cooling pipe 133. The first side recessed portion Rb is provided in the inner surface 12c of the first side surface portion 12b2. The first side recessed portion Rb is configured to be fitted to each of the first cooling pipe 131, the second cooling pipe 132, and the third cooling pipe 133. The second side recessed portion Rc is provided in the inner surface 12c of the second side surface portion 12b3. The second side recessed portion Rc is configured to be fitted to each of the first cooling pipe 131, the second cooling pipe 132, and the third cooling pipe 133.

A center CL of the shell pipe portion 13 is located further inside the main body portion 12b than the inner surface 12c of the main body portion 12b. The center CL of the shell pipe portion 13 is a center in a cross section in a direction perpendicular to a flow of the hot water flowing through the shell pipe portion 13. The center CL of the shell pipe portion 13 is located further inside the main body portion 12b than the inner surface 12c of each of the back surface portion 12b1, the first side surface portion 12b2 and the second side surface portion 12b3.

Figure 9:
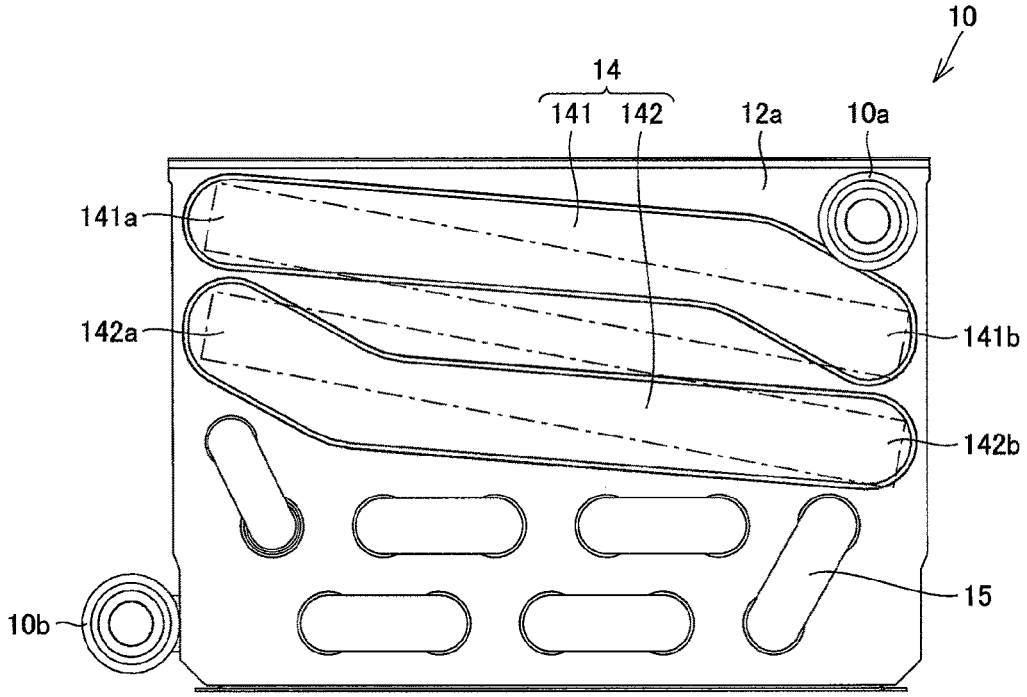
FIG. 9 is a front view schematically showing the configuration of the heat exchanger according to the embodiment of the disclosure.

As shown in FIGS. 4 and 9, the header member 14 is disposed on the outer surface 12a3 of the front surface portion 12a. The header member 14 includes a first header member 141 and a second header member 142. The first header member 141 is installed on the front surface portion 12a. Specifically, the first header member 141 is installed on the pipe installation plate 12a1. The second header member 142 is installed on the front surface portion 12a. Specifically, the second header member 142 is installed on the pipe installation plate 12a2.

The second header member 142 has the same shape as the first header member 141. The first header member 141 and the second header member 142 are installed on the front surface portion 12a in a manner opposite to each other.

The first header member 141 includes a first end 141a connected to the first cooling pipe 131 and a second end 141b connected to the second cooling pipe 132. The first header member 141 is inclined downward from the first end 141a toward the second end 141b. The first header member 141 is curved from the first end 141a toward the second end 141b. The second header member 142 includes a first end 142a connected to the second cooling pipe 132 and a second end 142b connected to the third cooling pipe 133. The second header member 142 is inclined downward from the first end 142a toward the second end 142b. The second header member 142 is curved from the first end 141a toward the second end 141b.

Figure 10:
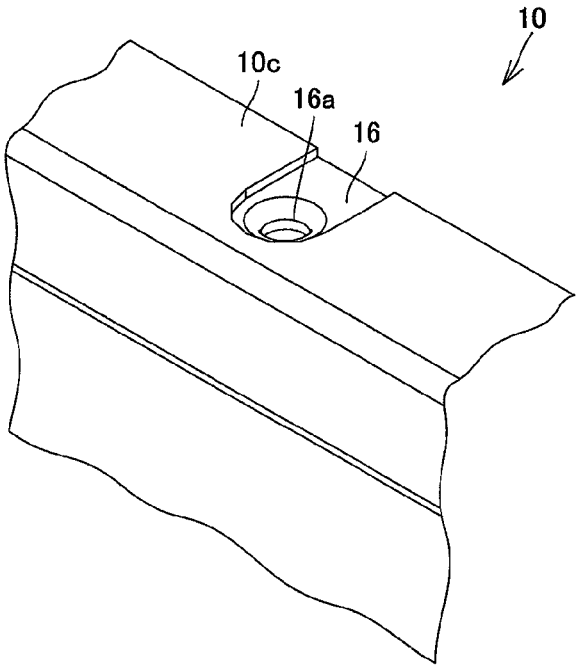
FIG. 10 is an enlarged view showing a portion X of FIG. 3.

As shown in FIGS. 3 and 10, the primary heat exchanger 10 has a flange portion 10c provided at an upper end of the shell plate 12. The primary heat exchanger 10 has an air supply connection flange 16 for connecting the burner 30 to the primary heat exchanger 10. The air supply connection flange 16 is formed in a U shape along the flange portion 10c. A screw hole 16a is provided in the air supply connection flange 16. A screw is screwed into the screw hole 16a, and thus the burner 30 is fixed to the primary heat exchanger 10.

The air supply connection flange 16 is connected to a lower surface of the flange portion 10c by spot welding. Therefore, since the air supply connection flange 16 is not connected to the shell plate 12 by brazing, it is possible to prevent a brazing material from adhering to the screw hole 16a.

As shown in FIGS. 4 and 5, the first cooling pipe 131 and the second cooling pipe 132 form a series of water flow paths via the first header member 141. One end of the first cooling pipe 131 is connected to the water inlet portion 10a. The other end of the first cooling pipe 131 is connected to the first header member 141. One end of the second cooling pipe 132 is connected to the first header member 141. That is, the other end of the first cooling pipe 131 is connected to the second cooling pipe 132 via the first header member 141.

The second cooling pipe 132 and the third cooling pipe 133 form a series of water flow paths via the second header member 142. The other end of the second cooling pipe 132 is connected to the second header member 142. One end of the third cooling pipe 133 is connected to the second header member 142. That is, the other end of the second cooling pipe 132 is connected to the third cooling pipe 133 via the second header member 142. The other end of the third cooling pipe 133 is connected to the bend pipe 15 disposed at the uppermost side. That is, the other end of the third cooling pipe 133 is connected to the fin pipe 11*b* via the bend pipe 15 disposed at the uppermost side.

Figure 11:
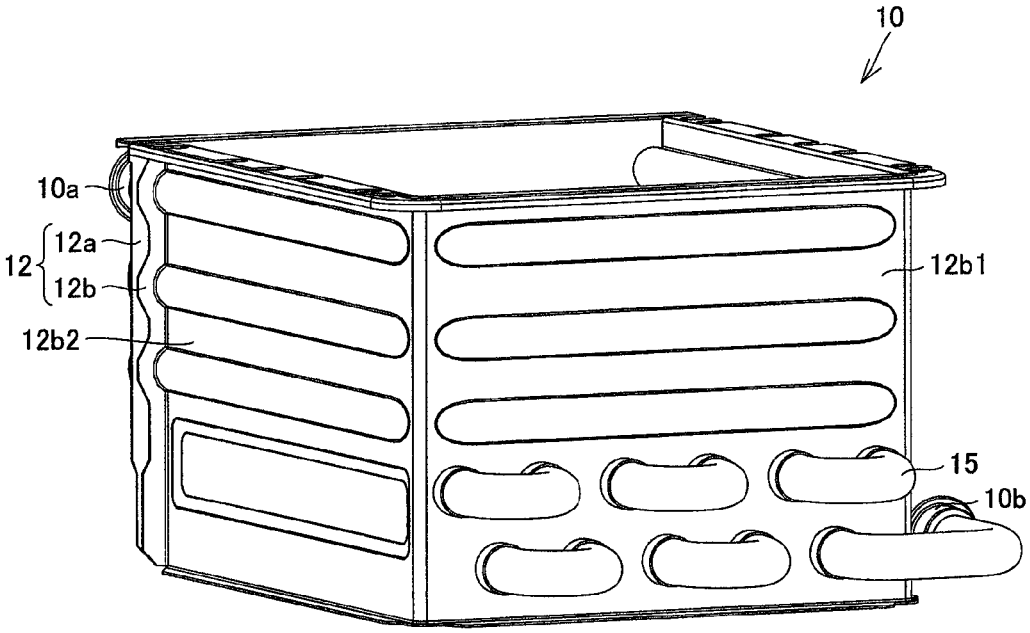
FIG. 11 is a perspective view schematically showing the configuration of the heat exchanger according to the embodiment of the disclosure from a back surface side.

As shown in FIGS. 5, 9 and 11, the plurality of fin pipes 11*b* are connected to each other in series by the bend pipe 15. In other words, the plurality of fin pipes 11*b* form a series of water flow paths through the bend pipe.

Next, the flow of the hot water flowing through the shell pipe portion 13 and the fin pipes 11*b* in the primary heat exchanger 10 will be described with reference to FIG. 4 and FIG. 5.

The hot water entering from the water inlet portion 10*a* enters the first cooling pipe 131 disposed at the uppermost side of the shell pipe portion 13. The hot water which has entered the first cooling pipe 131 passes through the inside of the first cooling pipe 131 and reaches the first header member 141. The hot water which has reached the first header member 141 enters the second cooling pipe 132 disposed below the first cooling pipe 131. The hot water which has entered the second cooling pipe 132 passes through the second cooling pipe 132 and reaches the second header member 142. The hot water which has reached the second header member 142 enters the third cooling pipe 133 disposed below the second cooling pipe 132. The hot water which has entered the third cooling pipe 133 passes through the inside of the third cooling pipe 133 and reaches the bend pipe 15 disposed at the uppermost side.

The hot water which has reached the bend pipe 15 disposed at the uppermost side flows through a series of water flow paths, in which the plurality of fin pipes 11*b* and a plurality of bend pipes 15 are connected in series, to be returned in a direction in which the front surface portion 12*a* and the back surface portion 12*b*1 face each other. Finally, the hot water exits from the hot water outlet portion 10*b*.

Next, the operation and effect of the embodiment will be described.

As shown in FIGS. 3 and 4, according to the primary heat exchanger 10 of the embodiment, the shell plate 12 can be cooled by the shell pipe portion 13. Further, since the main body portion 12*b* of the shell plate 12 is formed by bending one sheet of plate into a U shape, the number of components of the shell plate 12 can be reduced. Also, since the shell pipe portion 13 is bent into a U shape, the number of components of the shell pipe portion 13 can be reduced. Therefore, assemblability of the primary heat exchanger 10 can be improved. In addition, since the shell pipe portion 13 is bent in a U shape along the inner surface 12*c* of the main body portion 12*b*, it is easy to install the shell pipe portion 13 on the inner surface 12*c* of the main body portion 12*b*. Therefore, the assemblability of the primary heat exchanger 10 can be improved.

As shown in FIGS. 7 and 8, in the primary heat exchanger 10 of the embodiment, the recessed portion R is configured to be fitted to the shell pipe portion 13. Therefore, the shell pipe portion 13 can be held by the recessed portion R.

Further, as shown in FIG. 4, since the recessed portion R is provided in the inner surface 12*c* of the main body portion 12*b* bent into a U shape, the shell pipe portion 13 can be inserted into the main body portion 12*b* along the recessed portion R from one open surface of the main body portion 12*b*. Therefore, the shell pipe portion 13 can be installed in the recessed portion R along the recessed portion R.

Figure 12:
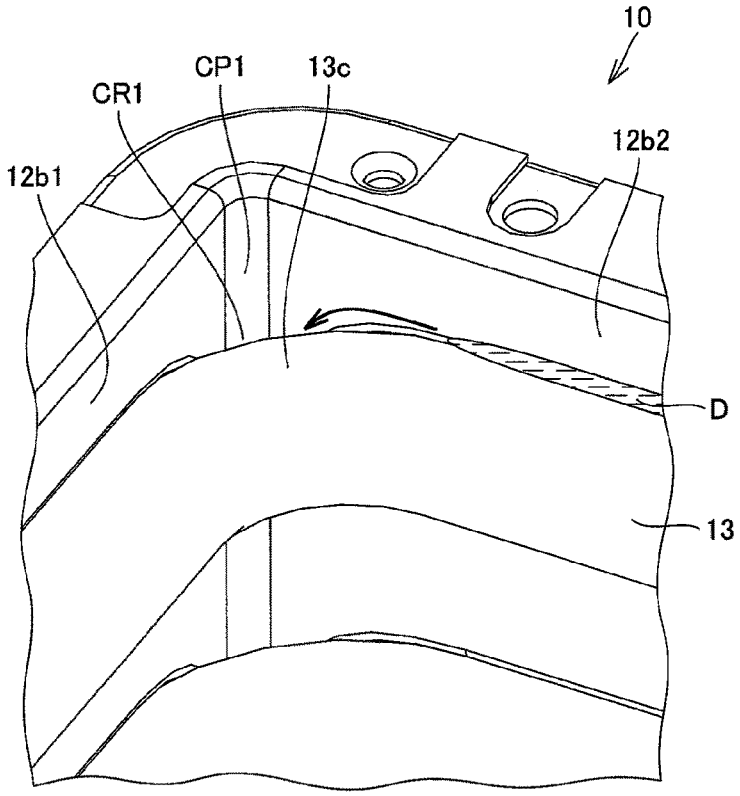
FIG. 12 is an enlarged view showing a portion XII of FIG. 3.

Referring to FIG. 12, in the primary heat exchanger 10 of the embodiment, the first curved portion 13*c* is disposed with the first gap CR1 between the first curved portion 13*c* and the first corner portion CP1. Therefore, drainage D can flow through the first gap CR1 as indicated by an arrow in the drawing. Also, as shown in FIG. 5, the second curved portion 13*e* is disposed with the second gap CR2 between the second curved portion 13*e* and the second corner portion CP2. Therefore, the drainage can flow through the second gap CR2. Therefore, it is possible to minimize formation of a drainage accumulation on the shell pipe portion 13. Therefore, it is possible to minimize condensation of the drainage due to evaporation of the drainage in this drainage accumulation. As a result, corrosion of the shell pipe portion 13 due to condensed drainage can be minimized.

Figure 13:
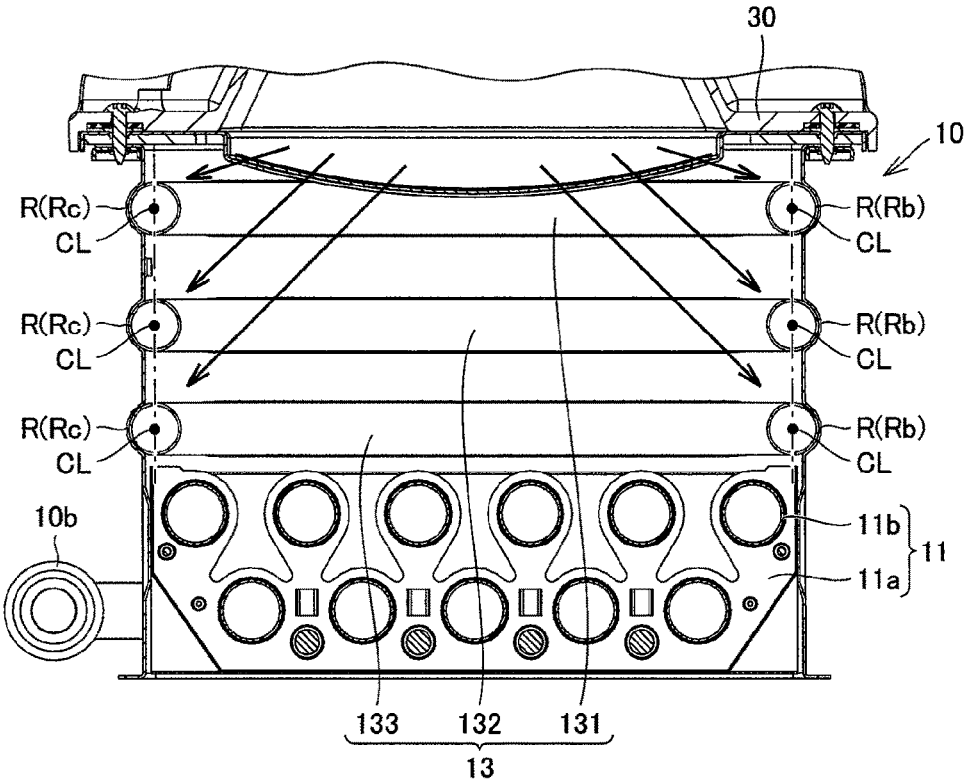
FIG. 13 is a cross-sectional view showing a flow of a combustion gas in the heat exchanger according to the embodiment of the disclosure.

A state in which the combustion gas flows to the primary heat exchanger 10 will be described with reference to FIG. 13. As shown in FIG. 13, the combustion gas supplied from the burner 30 flows obliquely downward as indicated by an arrow in the drawing. FIG. 13 is a cross-sectional view taken along a section corresponding to FIG. 8. In the primary heat exchanger 10 of the embodiment, the center CL of the shell pipe portion 13 is located further inside the main body portion 12*b* than the inner surface 12*c* of the main body portion 12*b*. Therefore, a region located below the shell pipe portion 13 of the shell plate 12 is hidden by the shell pipe portion 13 with respect to the flow of the combustion gas. Therefore, the flow of the combustion gas to the shell plate 12 is hindered by the shell pipe portion 13, and thus it is possible to minimize the combustion gas reaching the shell plate 12. As a result, it is possible to minimize an increase in a temperature of the shell plate 12.

As shown in FIGS. 4 and 7, in the primary heat exchanger 10 of the embodiment, since the first cooling pipe 131 and the second cooling pipe 132 are disposed side by side in the vertical direction YD, a range in which the shell plate 12 is cooled can be expanded in the vertical direction YD. Further, in the case in which the first cooling pipe 131 is connected in parallel to the second cooling pipe 132, when one of the first cooling pipe 131 and the second cooling pipe 132 is clogged with scale precipitated due to minerals contained in tap water, the hot water flows to the other side which is not clogged with the scale. Therefore, a temperature of the shell plate 12 around the one clogged with the scale is very high. In the primary heat exchanger 10 of the embodiment, since the first cooling pipe 131 is connected in series to the second cooling pipe 132, when one of the first cooling pipe 131 and the second cooling pipe 132 is clogged with the scale, no hot water flows through the entire shell pipe portion 13. Therefore, it is easy to find out that one of the first cooling pipe 131 and the second cooling pipe 132 is clogged with the scale. Thus, when one of the first cooling pipe 131 and the second cooling pipe 132 is clogged with the scale, it is possible to prevent the temperature of the shell plate 12 from becoming extremely high by stopping the hot water apparatus 100. Also, since the first cooling pipe 131 and the second cooling pipe 132 are disposed side by side in the horizontal direction XD, the first cooling pipe 131 and the second cooling pipe 132 can be formed in the same shape. Accordingly, it is possible to reduce the number of types of component. Therefore, production efficiency can be improved.

As shown in FIGS. 4 and 7, in the primary heat exchanger 10 of the embodiment, the first cooling pipe 131 and the second cooling pipe 132 form a series of water flow paths via the first header member 141. Since the first header member 141 protrudes less than the bend pipe 15 from the shell plate 12, the primary heat exchanger 10 can be formed to be compact.

As shown in FIGS. 4 and 7, in the primary heat exchanger 10 of the embodiment, the first cooling pipe 131 is disposed above the second cooling pipe 132. One end of the first cooling pipe 131 is connected to the water inlet portion 10*a*. The other end of the first cooling pipe 131 is connected to the second cooling pipe 132 via the first header member 141. Therefore, the hot water can flow downward from the first cooling pipe 131 to the second cooling pipe 132 via the first header member 141.

As shown in FIGS. 4 and 9, in the primary heat exchanger 10 of the embodiment, the first header member 141 is inclined downward from the first end 141*a* connected to the first cooling pipe 131 toward the second end 141*b* connected to the second cooling pipe 132. Vapor is accumulated in an upper end inside the first header member 141. When the first header member 141 is formed horizontally from the first end 141*a* toward the second end 141*b*, since a volume in which the vapor accumulates in this upper end increases, an area to which chlorine components contained in the vapor adhere in this upper end increases. In the primary heat exchanger 10 of the embodiment, since the first header member 141 is inclined downward from the first end 141*a* toward the second end 141*b*, the volume in which the vapor accumulates in the upper end inside the pipe of the first header member 141 decreases. Therefore, it is possible to reduce the area to which the chlorine components contained in the vapor adhere in this upper end. Thus, corrosion of the first header member 141 due to the chlorine components can be minimized.

Referring to FIG. 9, the first header member 141 in the case in which the first header member 141 is linearly formed from the first end 141*a* toward the second end 141*b* is indicated by a broken line. Further, similarly, the second header member 142 is also indicated by a broken line. In the primary heat exchanger 10 of the embodiment, the first header member 141 is curved from the first end 141*a* toward the second end 141*b*. Therefore, a distance along the front surface portion 12*a* of the first header member 141 can be made longer than in the case in which the first header member 141 is formed linearly from the first end 141*a* toward the second end 141*b*. Thus, a cooling effect due to the first header member 141 in the front surface portion 12*a* can be increased.

As shown in FIGS. 4 and 9, in the primary heat exchanger 10 of the embodiment, the second header member 142 has the same shape as the first header member 141. Therefore, it is possible to reduce the number of types of component. Thus, the production efficiency can be improved.

As shown in FIGS. 4 and 5, in the primary heat exchanger 10 of the embodiment, the linear expansion coefficient of the material of each of the plurality of fins 11*a* and the shell plate 12 is smaller than the linear expansion coefficient of the material of the plurality of fin pipes 11*b*. The temperature of each of the plurality of fins 11*a* and the shell plate 12 around which the combustion gas flows is higher than the temperature of the plurality of fin pipes 11*b* through which the hot water flows. Since the linear expansion coefficient of the material of each of the plurality of fins 11*a* and the shell plate 12 is smaller than the linear expansion coefficient of the material of the plurality of fin pipes 11*b*, stress concentration due to thermal stress generated between the plurality of fin pipes 11*b* and the plurality of fins 11*a* and the shell plate 12 can be alleviated.

As shown in FIG. 1, the hot water apparatus 100 of the embodiment includes the above-described primary heat exchanger 10 and the burner 30 for generating a heating gas which is supplied to the primary heat exchanger 10. According to the hot water apparatus 100 of the embodiment, it is possible to provide the hot water apparatus 100 having the primary heat exchanger 10 which can cool the shell plate 12 and which has good assemblability.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A heat exchanger, comprising:

a heat exchanging portion;

a shell plate which surrounds the heat exchanging portion; and a shell pipe portion which cools the shell plate, wherein the shell plate comprises a front surface portion and a main body portion which is installed on the front surface portion and formed by bending one sheet of plate into a U shape, the shell pipe portion is bent in a U shape and situated along an inner surface of the main body portion and is installed on the inner surface, wherein the shell pipe portion comprises:

a first cooling pipe bent in a U shape;

a second cooling pipe bent in a U shape which are disposed side by side in a vertical direction; and a third cooling pipe disposed to be parallel to the first cooling pipe and the second cooling pipe in the vertical direction, wherein the first cooling pipe is disposed above the second cooling pipe, and the third cooling pipe is disposed below the second cooling pipe; and a first header member installed on the front surface portion, wherein water flows through the first cooling pipe and the second cooling pipe as a series of water flow paths via the first header member, wherein one end of the first cooling pipe is connected to a water inlet portion, and the other end of the first cooling pipe is connected to the second cooling pipe via the first header member; and a second header member installed on the front surface portion, wherein the second header member has the same shape as the first header member.

2. The heat exchanger according to claim 1, wherein the inner surface of the main body portion comprises a recessed portion, and the recessed portion is formed to be fitted to the shell pipe portion.

3. The heat exchanger according to claim 1, wherein the main body portion comprises a back surface portion together with the front surface portion disposed to sandwich the heat exchanging portion, and a first side surface portion and a second side surface portion disposed to extend from both ends of the back surface portion toward the front surface portion, the shell pipe portion comprises a back pipe portion installed on the back surface portion, a first side pipe portion installed on the first side surface portion, a first curved portion which connects the back pipe portion with the first side pipe portion, a second side pipe portion installed on the second side surface portion, and a second curved portion which connects the back pipe portion with the second side pipe portion, the first curved portion is disposed with a first gap between the first curved portion and a first corner portion formed by the back surface portion and the first side surface portion, and the second curved portion is disposed with a second gap between the second curved portion and a second corner portion formed by the back surface portion and the second side surface portion.

4. The heat exchanger according to claim 1, wherein a center of the shell pipe portion is located further inside the main body portion than the inner surface of the main body portion.

5. The heat exchanger according to claim 1, wherein the first cooling pipe is connected in series to the second cooling pipe, and each of the first cooling pipe and said second cooling pipe is installed to extend in a horizontal direction.

6. The heat exchanger according to claim 1, wherein the first header member comprises a first end connected to the first cooling pipe and a second end connected to the second cooling pipe, and the first header member is inclined downward from the first end toward the second end.

7. The heat exchanger according to claim 6, wherein the first header member is curved from the first end toward the second end.

8. The heat exchanger according to claim 1, the second cooling pipe and the third cooling pipe form a series of water flow paths via the second header member.

9. The heat exchanger according to claim 1, wherein the heat exchanging portion comprises a plurality of tins stacked on each other, and a plurality of fin pipes which pass through the plurality of fins, and a linear expansion coefficient of a material of each of the plurality of fins and the shell plate is smaller than a linear expansion coefficient of a material of the plurality of fin pipes.

10. A hot water apparatus comprising:

the heat exchanger according to claim 1; and a burner which generates a heating gas to be supplied to the heat exchanger.

* * * * *